United States Patent [19]

Langford

[11] 4,239,457

[45] Dec. 16, 1980

[54] REMOTE RESET

[76] Inventor: R. C. Langford, Box 227, Rule, Tex. 79547

[21] Appl. No.: 52,791

[22] Filed: Jun. 28, 1979

[51] Int. Cl.[3] ..... F04B 49/00

[52] U.S. Cl. ..... 417/33; 200/61.45 M; 200/153 F; 200/161; 200/331

[58] Field of Search ..... 417/33, 1, 9, 12, 13; 200/61.45 R, 61.45 M, 61.5, 161, 153 F, 331, 332, 61.77, 61.8; 251/294

[56] References Cited

U.S. PATENT DOCUMENTS

| | | | |
|---|---|---|---|
| 352,043 | 11/1886 | Cox | 200/161 |
| 602,434 | 4/1898 | Diehl | 200/161 |
| 1,032,896 | 7/1912 | Hagan | 417/33 |
| 2,550,093 | 4/1951 | Smith | 417/33 |
| 2,764,393 | 9/1956 | Geyer | 251/294 X |
| 3,269,320 | 8/1966 | Tilley et al. | 417/1 X |
| 3,641,290 | 2/1972 | Murphy et al. | 200/61.45 R |
| 3,720,936 | 3/1973 | Kahale et al. | 200/61.45 M |

*Primary Examiner*—Carlton R. Croyle
*Assistant Examiner*—Edward Look
*Attorney, Agent, or Firm*—Wendell Coffee

[57] ABSTRACT

The finger is pivoted to the housing of a vibration switch mounted in a remote location. A cord attached to the finger leads to a convenient position. Pulling the cord resets the switch.

8 Claims, 4 Drawing Figures

Fig. 1
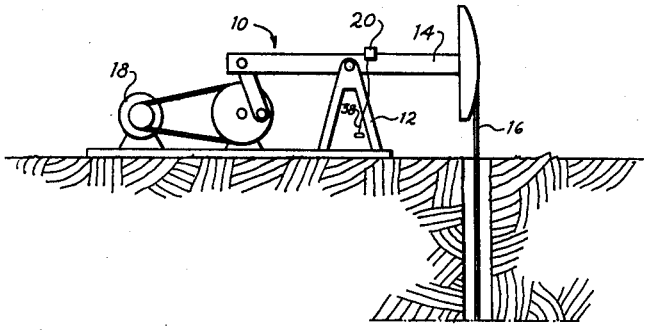
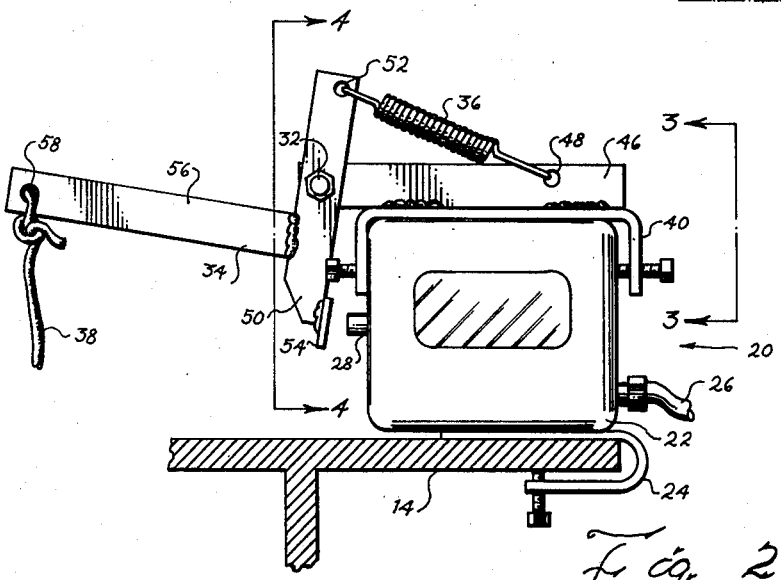
Fig. 2
Fig. 4
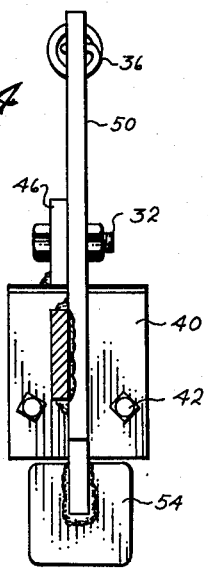
Fig. 3
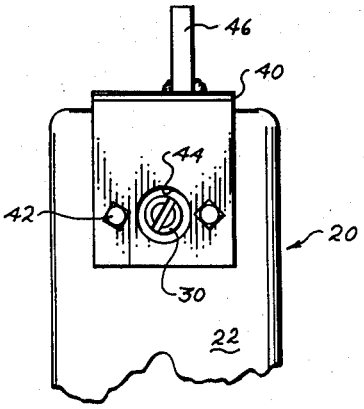

REMOTE RESET

CROSS-REFERENCE TO RELATED APPLICATIONS

None.

BACKGROUND OF THE INVENTION (1) Field of the Invention

This invention relates to vibration switches located in remote locations and more particularly to a device for resetting a tripped vibration switch.

(2) Description of the Prior Art

Large pump jacks are used in pumping oil from deep within the earth. These pump jacks are located at remote locations and operate automatically. It is desirable to place vibration switches upon the upper parts of the pump jacks. Excessive vibration will trip the switch and shut down the well. The switches are placed upon the upper parts of the pump jacks because the upper parts are more sensitive to vibration. The portions adjacent to the base almost never vibrate; it is the other portion, remote from the base that is up in the air, which vibrates.

These pump jacks are normally checked by a single pumper. At the present time if the vibration switch is tripped, it is necessary for the pumper to climb the pump jack to manually reset the vibration switch mounted thereon. Inasmuch as he is working alone at a remote location, this poses a particular danger even though he may be no more than ten or fifteen feet above the ground. Furthermore, these pump jacks are open, exposed to the elements and ladders may often be wet, covered with ice or the like.

Also, vibration switches have general utility for being attached to other machinery in remote locations. In any location not readily convenient to be reset, a problem exists.

Vibration switches are well known. For example, the vibration switches built according to U.S. Pat. No. 3,641,290 are commercially upon the market. These vibration switches have a sensitivity control as well as a reset button.

To be effective the vibration switch must be set so that it trips off at a certain level of vibration. There is always a temptation upon the people required to reset these to change the sensitivity adjustment, thus avoiding the necessity to reset the switch so often.

SUMMARY OF THE INVENTION (1) New and Different Function

I have invented a remote reset device whereby the reset button upon the standard vibration switch may be activated from remote location. This achieves two distinct advantages. One, it removes the hazard of a workman having to climb or go to a remote location to reset the vibration switch thus subjecting himself to the hazards of such a journey and accomplishing the task more quickly. Two, since the workman does not approach the vibration switch and since the task of resetting the vibration switch is simple and easy, any temptation to reset the sensitivity adjustment of the switch is removed.

Thus, it may be seen that the total function of my invention far exceeds the sum of the functions of the individual cords, springs, fingers, etc.

(2) Objects of this Invention

An object of this invention is to provide a remote reset for a vibration switch.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a schematic representation of a pump jack as used on oil wells with the vibration switch shown mounted upon the walking beam.

FIG. 2 is a front elevational view of the vibration switch attached to supporting structure with my invention attached thereto.

FIG. 3 is a partial side elevational view looking at that part as would be seen from line 3—3 of FIG. 2.

FIG. 4 is a sectional view taken substantially on line 4—4 of FIG. 2.

DETAILED DESCRIPTION OF THE PREFERRED EMBODIMENT:

Referring to the drawings and particularly FIG. 1, there may be seen schematically represented a pump jack 10. A typical pump jack will have samson post 12 attached to a base. Walking beam 14 is fitted to the samson post having a horsehead at one end which is attached by means of a bridle to sucker rod 16. A connecting rod and crank mechanism is on the other end of the walking beam 14. A motor such as electric motor 18 is also mounted on the base to drive the crank. Vibration switch 20 is mounted upon the walking beam. As stated above, it is desirable that the vibration switch 20 be mounted where it is susceptible to vibrations particularly those of downhole vibrations and transmitted up through the sucker rod 16. In fact, it might be desirable to locate it even closer to the horsehead than illustrated in the drawing.

The vibration switch 20 (FIG. 2) has housing 22 with simple clamp 24 on the housing so that the housing may be securely attached to supporting structure, in this case the walking beam 14. Electrical conductors 26 enter the housing. The housing contains vibration elements for changing the resistance between the electrical conductors responsive to vibrations.

The electrical conductors which thereby detect the vibration connected by circuits, not shown for simplicity, to the electric motor 18 to shut down the motor and thus the well in the event the vibrations are strong enough to activate the vibration switch. When this occurs, the vibration switch can be reset by reset button 28. Also an adjustment screw 30 is contained upon the housing 22 of the switch 20 so that the severity of vibrations necessary to activate the switch may be adjusted.

Those having ordinary skill in the art will understand that the description of the elements to this point are all well-known and commercially on the market. As stated before, vibration switches as described are disclosed in U.S. Pat. No. 3,641,290.

To the mechanisms described I attach a remote reset. Basically the remote reset includes pivot pin 32 attached to the housing 22. Finger 34 is pivoted to the pin 32. The finger 34 is biased by spring 36 away from the reset button 28. Cord 38 forms a lanyard extending from the finger 34 to an accessible point so that the workman by pulling on the cord 38 may bring the finger against the reset button 28 resetting the same.

Those having skill in the art will understand that the housing 22 could be constructed with ears projecting from it to carry the pivot pin 32. However, for those units already in operation I provide bracket 40. As may be seen particularly in FIG. 2 the bracket is U-shaped having the top portions and the two legs depending therefrom. Each of the legs has two set screws 42 extending therethrough which bear against the housing 22 to hold the U-shaped bracket securely in place. As seen in FIG. 3 on one leg between the two set screws 42 there is an aperture 44 providing access to the sensitivity adjustment screw 30. Rib 46 extends along the top of the U-shaped bracket and is attached thereto as by welding. One end of the rib 46 extends beyond the end of the housing 42 and is drilled for receiving the pivot pin 32. The spring 36 has one end attached to the top of a portion of finger 34 and the other attached through hole 48 in the rib 46.

The finger 34 itself is in the form of a T. Cross 50 of the T has the pin 32 extending through it at approximately mid-point. Hole 52 to receive spring 36 is at the top of the cross 50 and pad 54 to press against the reset button 28 is the bottom thereof. Stem 56 of the T-shaped finger 34 is welded to the cross 50 a short distance from the point where the pivot pin 32 extends through. However, the exact location of the connection of the stem 56 to the cross 50 is not critical. The end of the stem has lanyard hole 58 through which the cord 38 is attached.

As an aid to correlating the terms of the claims to the exemplary drawing, the following catalog of elements is provided:

| | | | |
|---|---|---|---|
| 10 | pump jack | 36 | spring |
| 12 | samson post | 38 | cord |
| 14 | walking beam | 40 | bracket |
| 16 | sucker rod | 42 | set screws |
| 18 | motor | 44 | aperture |
| 20 | vibration switch | 46 | rib |
| 22 | housing | 48 | hole |
| 24 | clamp | 50 | cross of the T |
| 26 | electrical conductors | 52 | hole |
| 28 | reset button | 54 | pad |
| 30 | adjustment screw | 56 | stem |
| 32 | pivot pin | 58 | lanyard hole |
| 34 | finger | | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a vibration switch having a. a housing, b. electrical conductors entering said housing, c. vibration elements within said housing for changing the resistence between said electrical conductors responsive to vibration, d. a reset button on said housing for resetting said vibration elements within the housing to their original condition, e. said vibration switch mounted at a remote location, wherein the improvement comprises the improved structure for pushing said reset button and thus resetting the switch:

f. a pivot pin mounted on the housing of the vibration switch, g. a finger pivoted to the pin, h. a spring biasing the finger away from the reset button, i. a cord attached to the finger so that when the cord is pulled the finger pushes against the button resetting the same.

2. The invention as defined in claim 1 further comprising:

k. said pivot pin mounted upon a bracket, m. said bracket attached to said housing, n. said bracket being U-shaped thus having legs, o. set screws through the legs bearing against the housing, thereby p. holding the bracket in position over the housing with the finger opposite said reset button, and q. said spring extending from between the finger and the bracket.

3. The invention as defined in claim 2 further comprising:

r. said vibration switch also having a screw adjustment for sensitivity, s. said screw adjustment for sensitivity extending through said housing, t. said bracket over said screw through said housing, and u. a hole in the bracket so that said screw is available for adjustment with the bracket in place.

4. The invention as defined in claim 3 further comprising:

v. said finger is T-shaped with w. a cross and x. a stem, y. said cord attached to the stem and z. said pivot pin through the cross and aa. said spring attached to the cross.

5. On an oil well having a. sucker rod, b. a pump jack for reciprocating said sucker rod, c. said pump jack including (i) samson post, and (ii) a walking beam, and d. a vibration switch including e. a housing, f. electrical conductors entering said housing, g. vibration elements within said housing for changing the resistence between said electrical conductors responsive to vibration, h. a reset button on said housing for resetting said vibration elements within the housing to their original condition, j. said vibration switch mounted on the pump jack at a remote location, wherein the improvement comprises the improved structure for pushing said reset button and thus resetting the switch:

k. a pivot pin mounted on the housing of the vibration switch, m. a finger pivoted to the pin, n. a spring biasing the finger away from the reset button, o. a cord attached to the finger so that when the cord is pulled the finger pushes against the button resetting the same.

6. The invention as defined in claim 5 further comprising:

p. said pivot pin mounted upon a bracket, q. said bracket attached to said housing, r. said bracket being U-shaped thus having legs, s. set screws through the legs bearing against the housing, thereby t. holding the bracket in position over the housing with the finger opposite said reset button, and u. said spring extending from between the finger and the bracket.

7. The invention as defined in claim 6 further comprising:

v. said vibration switch also having a screw adjustment for sensitivity, w. said screw adjustment for sensitivity extending through said housing, x. said bracket over said screw through said housing, and y. a hole in the bracket so that said screw is available for adjustment with the bracket in place.

8. The invention as defined in claim 7 further comprising:

z. said finger is T-shaped with aa. a cross and bb. a stem, cc. said cord attached to the stem and dd. said pivot pin through the cross and ee. said spring attached to the cross.

* * * * *